United States Patent [19]

Jumpertz

[11] Patent Number: 5,038,767

[45] Date of Patent: Aug. 13, 1991

[54] DEVICE FOR TREATING RESPIRATION GAS WITH AN OXYGEN-RELEASING CHEMICAL CARTRIDGE

[75] Inventor: Werner Jumpertz, Lübeck, Fed. Rep. of Germany

[73] Assignee: Drägerwerk Aktiengesellschaft, Lübeck, Fed. Rep. of Germany

[21] Appl. No.: 529,242

[22] Filed: May 25, 1990

[30] Foreign Application Priority Data

May 26, 1989 [DE] Fed. Rep. of Germany ..... 3917096

[51] Int. Cl.[5] ..... A62B 7/08; A62B 21/00

[52] U.S. Cl. ..... 128/202.26; 422/120

[58] Field of Search ..... 128/202.26; 422/120

[56] References Cited

U.S. PATENT DOCUMENTS 4,197,213 4/1980 Pietz ..... 128/202.26

4,230,667 10/1980 Williams ..... 128/202.26

*Primary Examiner*—Edgar S. Burr

*Assistant Examiner*—Stephen R. Funk

*Attorney, Agent, or Firm*—McGlew & Tuttle

[57] ABSTRACT

A device for processing respiration gas with a filling of an oxygen-releasing chemical in a cartridge that can be received in a housing to which the respiration gas connection can be connected. The filling can be accommodated in a simple, inexpensive cartridge without having to give up protection from water vapor, as a result of which an inexpensive consumable part is to be obtained. To achieve this, the cartridge 1 is closed off with at least one bottom 8 that can be pushed into the inside of the cartridge and has openings 7 in it and is surrounded with a foil 10 that is impermeable to water vapor in a vacuum-tight manner (FIG. 1).

9 Claims, 2 Drawing Sheets

DEVICE FOR TREATING RESPIRATION GAS WITH AN OXYGEN-RELEASING CHEMICAL CARTRIDGE

FIELD AND BACKGROUND OF THE INVENTION

The present invention pertains to a device for processing respiration gas containing a filling of an oxygen-releasing chemical in a cartridge that can be accommodated in a housing to which the respiration gas connection can be connected.

Such devices are used, for example, for respirators in an atmosphere containing harmful substances and serve to generate oxygen independently when the ambient air cannot be used for supplying respiration gas because of the lack of possibilities of filtration. These include respirators with a closed respiration circuit, in which the respiration gas is prepared via a chemical cartridge containing $KO_2$ for regenerating the exhaled air. Here the exhaled $CO_2$ and the exhaled water vapor are reacted and oxygen is formed; this is returned into the respiration circuit. Such a device with a corresponding cartridge is described in West German Auslegeschrift (West German patent application laid open to public inspection after examination and acceptance by the German Patent Office) No. DE-AS 21,59,493.

In addition, the presence of a certain amount of oxygen reserve in the form of chlorate candles is necessary for certain applications of known respirators and resuscitating devices if the oxygen available in the ambient atmosphere is not sufficient. Such candles have a filling consisting of an alkali metal chlorate mixture which releases oxygen by burning after ignition and feeds it into the respiration circuit. Such respirators and resuscitating devices with the corresponding oxygen generator are described in West German Offenlegungsschrift No. DE-OS 34,22,021.

Because all the known chemicals are extremely sensitive to water vapor and are sensitive to shocks and vibrations in the consistency in which they occur, be it in the form of candles, pellets, or as a granular bulk filling, utmost care is needed during production and processing. Thus, on the one hand, it is to be ensured that all parts of the cartridge, which must be made of metal because of the heat evolving during the operation, should be water vapor-tight in order to avoid the undesirable activation of the chemical, which would lead to the premature release of oxygen, during the often prolonged storage. To prevent corrosion, all metal parts are to be made of special stainless steel. Consequently, the prior-art candles are complicated and expensive to produce, which is also manifested in high consumption costs, because the used candles cannot be reused. To provide a filling that is insensitive to shocks and vibrations, additional measures are required to pre-tension the contents of the cartridge in the case of a granular filling or to pad the cartridge in the case of a candle filling.

SUMMARY AND OBJECTS OF THE INVENTION

It is an object of the present invention to improve a device of the known type so that the filling can be accommodated in a simple, inexpensive cartridge without giving up protection against water vapor, as a result of which an inexpensive consumable part is to be obtained.

This task is accomplished by closing off the cartridge at least at one end with a bottom that can be pushed into the inside of the cartridge and is provided with openings and is surrounded in a vacuum-tight manner with a foil that is impermeable to water vapor.

The advantage of the present invention is essentially the fact that regardless of whether the filling is a candle filling or a granular bulk material, vibration-resistant accommodation of the filling in the cartridge housing is ensured. The movable bottom is pressed by the pressure of the foil on the evacuated contents of the cartridge against the contents of the cartridge, and it continuously ensures cohesion of the cartridge filling under pressure. Should the filling settle or shift during transportation or as a consequence of other vibrations, the pre-tension on the filling is maintained by the bottom, which can be pushed forward. It is possible to select an inexpensive material to produce the cartridge without the need to ensure that the material selected be particularly corrosion resistant. The connection points and seams no longer need be assembled so as to ensure that they be impermeable to gas and water vapor. This simplifies the production and avoids the expensive checking of the cartridge for leakage. The foil prevents water vapor from passing through and thus forms an inexpensive seal that can be prepared in a simple manner. The cartridges can be stored over long periods of time. The foil need only be torn immediately before use, and the cartridge removed and placed into the receiving housing. Because conventional prior-art plastic foils with aluminum backing can be used as the water vapor barrier for the vacuum-tight packaging, sealing can be achieved with simple means and without any special devices.

To ensure good ability of the cartridge to function even during use, it is advantageous to provide the housing which is to receive the cartridge with a spring pressure member which exerts a pressure on the movable bottom when the cartridge has been inserted and is no longer sealed. It is thus achieved that the intimate cohesion of the granules of the chemical, which is important for the function, continues to be ensured in the case of a granular bulk filling, or the connection of the filling to an igniting device is preserved even in the case of a cartridge with sodium chlorate filling. The cost of the cartridge is further reduced and replacement of the used cartridges is more inexpensive due to the fact that the spring pressure member is part of the receiving housing rather than being arranged in the cartridge itself.

The bottom is preferably secured by a holder against falling out of the cartridge. The holder can be, e.g., a circular bead or a spring ring.

The housing is preferably provided with a cover which can be fastened on the housing by means of a tensioning device. The cover may either contain the spring pressure member itself, so that it will exert the necessary spring pressure on the movable bottom when it is clamped or screwed onto said housing, or it can be arranged on the side of the housing opposite the spring pressure member when the cartridge has been inserted.

If the filling consists of an alkali metal chlorate mixture, especially sodium chlorate, a starting device, which is also surrounded by the foil in a vacuum-tight manner, can be arranged on the cartridge. Thus, the associated starting device is accommodated so that it is always protected during the replacement of the used cartridge.

If the filling consists of a chlorate mixture, it is useful to equip the cover lying on the starting device with an igniting device, by actuating which the starting device can be set into operation. Thus, the igniting device can be saved and reused on replacement of a cartridge.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which a preferred embodiment of the invention is illustrated.

DESCRIPTION OF THE PREFERRED EMBODIMENTS

Figure 1:
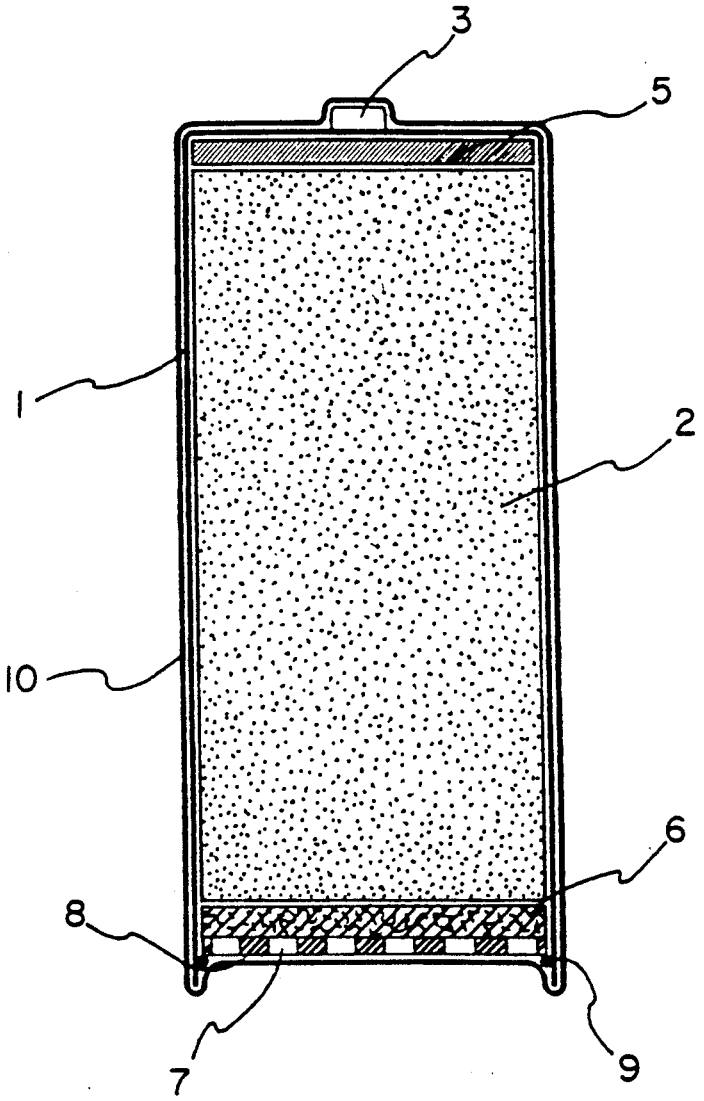
FIG. 1 is a sectional view of a chemical cartridge according to the invention, and, FIG. 2 is a schematic sectional view showing chemical cartridge received in a housing.

The cartridge 1 shown in FIG. 1 contains filling 2 consisting of a granular oxygen-releasing chemical, e.g., sodium perchlorate, as its principal component. A starting device 3, which causes a starter filling 5 consisting of a material that can be burned off to burn off by igniting it with an igniting device 4 (FIG. 2), is arranged on one front side of the cartridge 1. The starter filling consists of a mixture of sodium chlorate and silicon or magnesium as the catalyst. The filling 2 is closed off at the end opposite the starter filling 5 with a dust filter 6 to which a bottom 8 provided with perforations or passage openings 7 is attached. The bottom 8 is supported on the inner wall of the cartridge 1 by a snap ring 9, so that it cannot fall out of the cartridge 1 that is open at that location. The unit, including the cartridge 1 and the starting device 3, is vacuum-packed with an aluminum-backed foil 10 that is impermeable to water vapor, so that the outside ambient pressure compresses the foil 10, which closely surrounds the contours of the cartridge 1, including the starting device 3 and the bottom 8. Compact pressing of the contents of the cartridge is thus achieved. In addition, the contents are protected from the undesired entry of water vapor.

Figure 2:
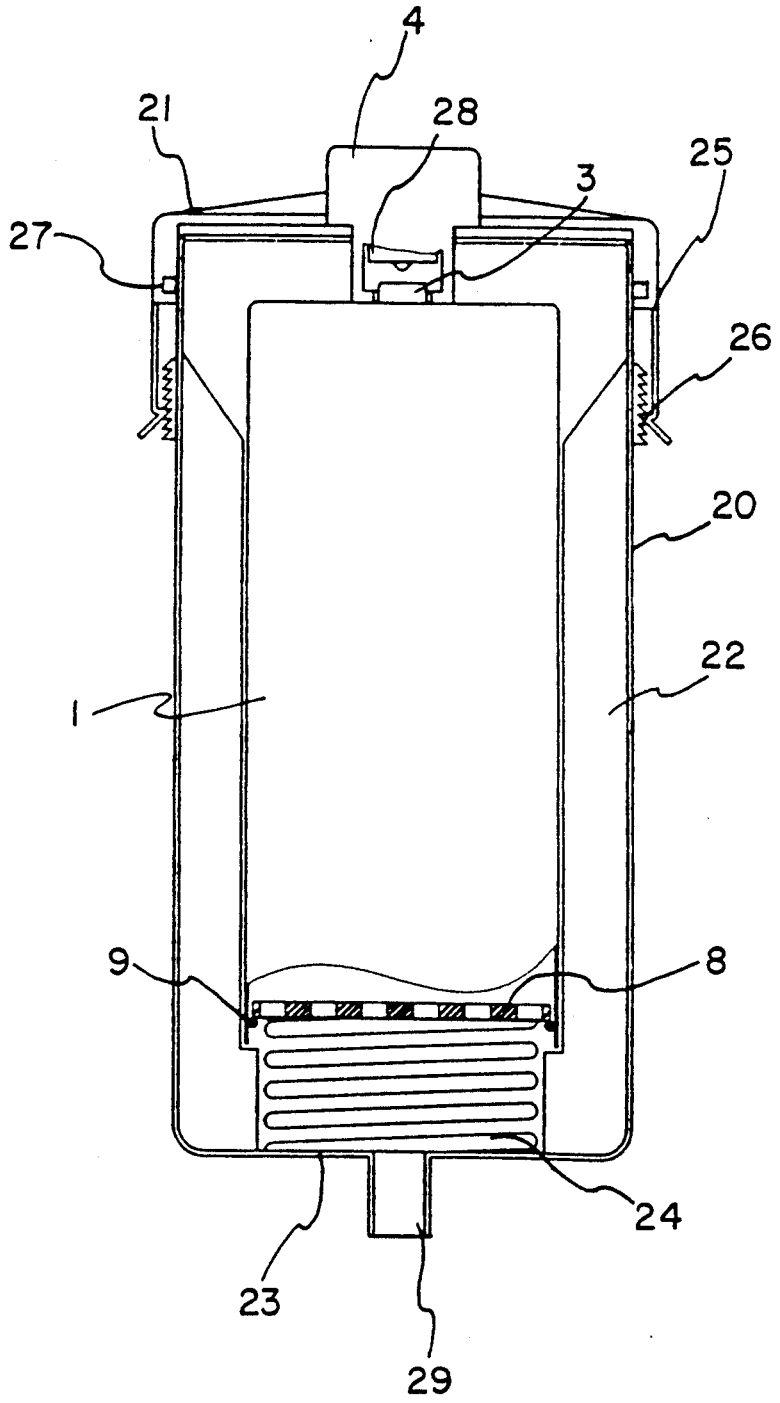

In FIG. 2, the cartridge 1 is accommodated in a housing 20, which is closed with a cover 21. The cartridge 1 rests in a base plate 22 of the housing 20, and a compression spring 24 acts between the housing bottom 23 and the cartridge bottom 8. The cartridge 1 is centered and fixed in the housing 20 by the cover 21 by means of the igniting device 4 and a clamp type fastener consisting of an elastic tensioning member 25 and a locking ring 26.

With the cover 21 in place, the tensioning member 25 engages with the locking ring 26 and seals the housing 20 via a sealing member 27. To start the release of oxygen by reacting the chemical filling 2, the igniting device 4 is actuated so that a cock (not shown) is released, as a result of which a striking pin 28 strikes the pressure-sensitive part of the starting device 3 and the thermal energy now released is used to ignite the chemical content of the starting device 3. The heat evolving in the starting device 3 is transmitted to the starter filling 5, which eventually induces the filling 2 to engage in an oxygen-releasing chemical reaction over a large surface. Dust particles that may be released during the evolution of oxygen and may be present before discharge from the passage opening are retained by the dust filter 6. Finally, the oxygen enters from the housing opening 29 into a respiration gas connection (not shown), which is connected to the breathing organs of the user of the respirator, also not shown.

While a specific embodiment of the invention has been shown and described in detail to illustrate the application of the principles of the invention, it will be understood that the invention may be embodied otherwise without departing from such principles.

What is claimed is:

1. A device for processing respiration gas with a filling of an oxygen-releasing chemical in a cartridge, the cartridge being accommodated in a housing which defines a receiving space, to which the respiration gas connection can be connected, comprising: an opening formed in a bottom of the cartridge; a bottom member closing off the bottom of the cartridge, said bottom member being provided with openings; and a removable flexible foil surrounding the cartridge, said foil being impermeable to water vapor and sealing, by surrounding the cartridge, to define a vacuum sealed interior to provide a pre tension on the exterior of said cartridge and on said bottom, said foil being removed from said cartridge immediately before said cartridge is positioned in said housing receiving space.

2. A device according to claim 1, wherein the housing includes a spring pressure member, said cartridge being positioned in the receiving space such that said spring pressure member acts on said bottom member to exert a displacing force on said bottom member in the direction of the inside of the cartridge.

3. A device according to claim 1, wherein said bottom member is secured to the cartridge by a holder element arranged in an inner circumference of the cartridge, said holder member being positioned so as to not hinder displacement of said bottom member in the direction of the inside of the cartridge.

4. A device according to claim 1, wherein the housing includes a cover fastened to the housing by means of a tensioning device.

5. A device according to claim 1, wherein said filling comprises an alkaline metal chlorate mixture, said cartridge including a starting device positioned at the end of the cartridge opposite the open bottom, said starting device being surrounded by said foil in said vacuum sealed interior.

6. A device according to claim 5, wherein said alkaline metal chlorate mixture is a sodium chlorate mixture.

7. A device according to claim 5, further comprising a cover fastened to said housing, said cover including an igniting device lying on said starting device when the cartridge is positioned in said receiving space, said igniting device being actuated for setting said starting device into operation.

8. A respirator gas processor comprising:

a cartridge having an open bottom; an oxygen releasing chemical disposed in said cartridge; a bottom member provided with openings, said bottom member closing said cartridge open bottom; removable flexible foil means surrounding said cartridge, said foil being formed of a material impermeable to water vapor and surrounding said cartridge to define a vacuum sealed interior region, said flexible foil means for exerting a force on the exterior of said cartridge and said bottom; and, a housing defining a cartridge receiving space for receiving said cartridge, said housing having an opening for connection with a respirator gas connection, said foil being removed from said cartridge immediately before said cartridge is positioned in said housing receiving space.

9. A respirator gas processor comprising:

a cartridge having an open bottom; an oxygen releasing chemical disposed in said cartridge, said chemical comprising an alkaline metal chlorate mixture; a starting device positioned at an upper end of said cartridge; a starter filling positioned between said starting device and said chemicals; a bottom member provided with openings, said bottom member closing said cartridge open bottom; removable flexible foil means surrounding said cartridge, said flexible foil means being formed of a material impermeable to water vapor and surrounding said cartridge to define a vacuum sealed interior region, said flexible foil means for exerting a force on the exterior of said cartridge and said bottom; and, a housing defining a cartridge receiving space for receiving said cartridge, said housing having an opening for connection with a respirator gas connection, said foil being removed from said cartridge immediately before said cartridge is positioned in said housing receiving space.

* * * * *